US006216415B1

(12) United States Patent
Briosi

(10) Patent No.: US 6,216,415 B1
(45) Date of Patent: Apr. 17, 2001

(54) ELEMENT OF LOAD-BEARING STRUCTURES, ESPECIALLY GIRDERS FOR MODULAR SHELVES

(75) Inventor: Antonello Briosi, Rovereto (IT)

(73) Assignee: Metalsistem S.p.A., Rovereto (IT)

( * ) Notice: Subject to any disclaimer, the term of this patent is extended or adjusted under 35 U.S.C. 154(b) by 0 days.

(21) Appl. No.: 09/293,907

(22) Filed: Apr. 19, 1999

(51) Int. Cl.[7] ..... E04C 3/30
(52) U.S. Cl. ..... 52/737.2; 52/730.5
(58) Field of Search ..... 52/736.1, 736.2, 52/737.1, 733.2, 729.1, 737.2, 720.1, 721.2, 732.1, 736.3, 736.4, 666, 668, 732.2, 730.1, 730.5, 730.4

(56) References Cited

U.S. PATENT DOCUMENTS 5,595,040 * 1/1997 Chen ..... 52/729.1
5,913,794 * 6/1999 Chen ..... 52/729.1
5,943,838 * 8/1999 Madsen ..... 52/733.2
5,964,072 * 10/1999 Rasmussen ..... 52/666

* cited by examiner

*Primary Examiner*—Beth A. Stephan
(74) *Attorney, Agent, or Firm*—Bucknam and Archer

(57) ABSTRACT

The two ends of the girders used for the formation of modular shelves are provided with a pair of superposed fasteners wherein the inlet and outlet eyelets which circumscribe the passage slits of the fasteners, are exactly equal and coaxial with each other. The pair of fasteners, which are located near the corners of the ends of the girders, engage in restrained relation and correct vertical alignment with as many superposed indentations formed along vertical uprights of the modular shelves. The indentations and pair of fasteners have the same distance between centres and combine with each other, in stable and aligned restrained coupling, because of the equal and coaxial configuration of the sections of the passage slits of the fasteners.

3 Claims, 1 Drawing Sheet

ELEMENT OF LOAD-BEARING STRUCTURES, ESPECIALLY GIRDERS FOR MODULAR SHELVES

BACKGROUND OF THE INVENTION

1. Field of the Invention

The present invention relates to an element of loadbearing structures, in particular to a girder for modular shelves, which consists of a metal tubular section whose cross-section is an almost parallelepiped form with shaped sides and a height greater than its width, wherein both ends are substantially flat on at least one face or side and provided with a superposed pair of fasteners, protruding near the corners thereof.

The cross-sections of the inlet eyelets and the outlet eyelets which circumscribe the passage slits of said fasteners are perfectly equal and coaxial with each other. The two superposed fasteners of each end are spaced from each other and so configured as to enter into mutual restraining relation, at top and bottom, with as many pairs of indentations, also spaced, sequentially formed along vertical uprights of any type intended for modular shelves or like structures. The indentations of the uprights enter in a restrained relation with the fasteners of the girders, through a downward introduction movement which engages them in said inlet and outlet eyelets, through the slits of said fasteners.

2. Description of Prior Art

The known girders for modular shelves and the like are substantially formed by sections corresponding to those used for the present invention, except that the pairs of superposed fasteners, present at the ends of the girders, have the respective inlet and outlet eyelets different from one another, in particular, the inlet eyelets are generally larger than the outlet eyelets, so that the slits do not have the desired passage section uniformity. In this situation, even though this construction allows the connection and the transversal tieing of the girders to the uprights, forming the horizontal supports for shelves, modular containers, separators and the like on the shelves, it does not provide an adequate stable and precise positioning of the parts and an adequate restrained engagement with the respective indentations located on the uprights.

SUMMARY OF THE INVENTION

The object of the present invention is to eliminate the above drawbacks. The invention achieves this object by means of a girder for modular shelves by which the following results are obtained: the pairs of fasteners arranged in superposed alignment with each other at the ends of the girders have inlet and outlet eyelets which circumscribe the passage slits perfectly equal to one another, the pairs of fasteners are placed at a distance equal to the distance between the indentations sequentially obtained along the vertical uprights utilized in the construction of modular shelves and/or corresponding structures or the like. The pairs of fasteners located at the ends of the girders and provided with inlet and outlet eyelets of the passage slits equal to each other are substantially aligned at the corners of said sections and are formed by means of direct and simultaneous moulding.

The advantages achieved by the present invention consist essentially in that the connection of the ends of the girders with the corresponding uprights is obtained through the restrained coupling of pairs of fasteners having eyelets that are all equal and coaxial on as many pairs of indentations, causing all connections to be stable and perfectly aligned.

BRIEF DESCRIPTION OF THE DRAWINGS

The invention is described in more detail in the following, according to an embodiment described only by way of a nonlimiting example, reference being made to the attached drawings, in which.

DETAILED DESCRIPTION

Figure 1:
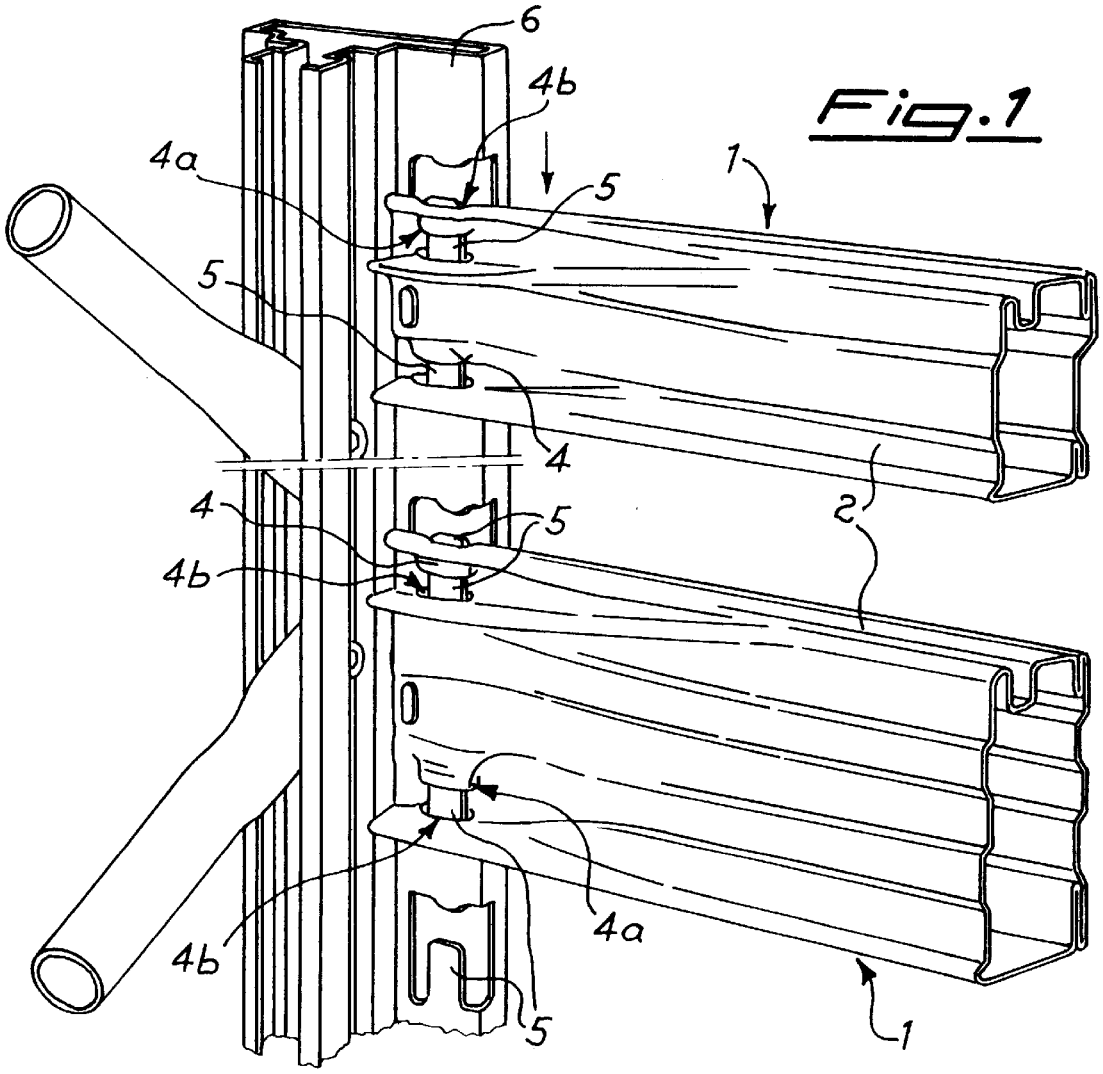
FIG. 1 is a perspective view of the end couplings of two different types of girders with an upright according to the invention.
Figure 2:
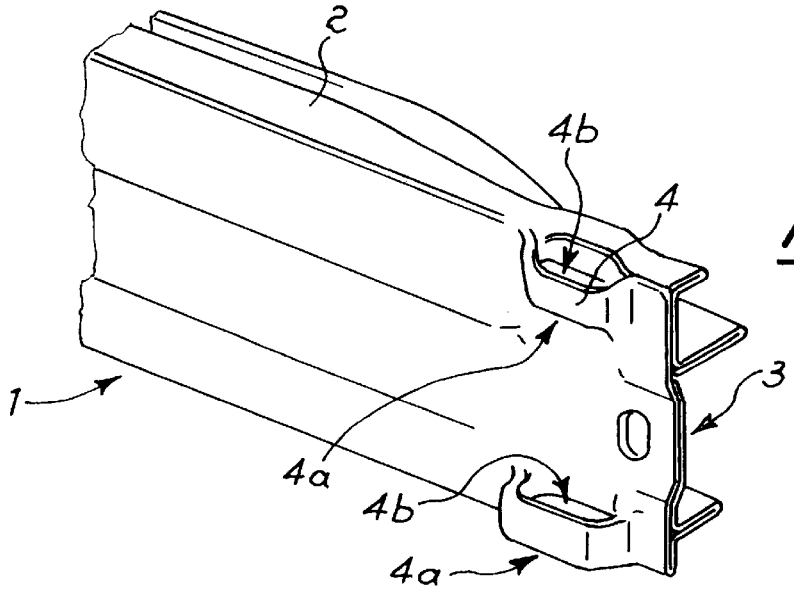
FIG. 2 is a perspective view of an end of a girder according to the invention.

The figures refer to girders 1 for modular shelves, wherein the girders are substantially formed as metal tubular sections 2 whose cross-section is a substantially parallelepiped form with shaped sides having a height greater than the width. Both ends 3 of girders 1 are substantially flat and provided with pairs of fasteners 4 superposed and protruding near the corners of ends 3.

The pair of fasteners 4 at end 3 are realized, preferably but not limitedly, by means of simultaneous moulding according to the known art of making or forming of the components for modular shelves and the like.

In each fastener 4, the lower inlet eyelet 4*a* and the upper outlet eyelet 4*b*, which circumscribe the passage slit, are exactly equal to each other and coaxially aligned in the vertical direction. The distance between the centers of the two superposed fasteners 4, present at both ends of each girder, is equal to the distance between the centers of indentations 5 sequentially obtained along the complementary vertical upright 6, designed for the forming of modular shelves and/or like structures. In this way, the pair of fasteners 4 of each end 3 of girder 1 are engaged in restrained relation at top and bottom in any one of the adjoining pairs of said indentations 5. The combination of superposed restrained engagement of two adjoining indentations with the two superposed fasteners 4 of each end 3 of girders 1, ensures a more effective engagement of the parts with the associated stability and alignment of the composite structure. This result is obtained by the fact that the inlet eyelet 4*a* and the outlet eyelet 4*b*, circumscribing the passage slits of the fasteners are exactly equal and coaxial with each other, and restrainingly engage in the same manner along the sides of the indentations.

Fasteners 4 with inlet eyelets 4*a* and outlet eyelets 4*b* having an identical section are advantageously obtained by moulding with simultaneous shearing and drawing.

While the present invention has been described and illustrated according to embodiments described only by way of nonlimiting example, it will be obvious to those skilled in the art that the shapes, the structure and the orientations may be subject to variations without departing from the spirit and scope of the following claims.

What is claimed is:

1. An element of load-bearing structures, in particular a girder for modular shelves, comprising a metal tubular section (2) having a parallelepiped cross-section with shaped sides and a height greater than a width thereof, said tubular section having two ends (3), each of which is substantially flat with end corners, each end is provided with a pair of fasteners (4) superposed and protruding adjacent said corners, said pair of fasteners are spaced from one another and configured so as to be coupled in restrained engagement from top to bottom with any pair of indentations (5) spaced and sequentially arranged along complementary vertical uprights (6) which are designed for modular shelves, wherein each fastener (4) has a lower inlet eyelet (4*a*) and an upper outlet eyelet (4*b*), circumscribing a slit extension of each fastener (4), said eyelets having exactly equal and coaxially aligned sections.

2. The element of load-bearing structures as defined in claim 1, wherein the coupling of one of the ends (3) of said girder with the corresponding upright (6) is comprised of the double restrained couplings of pairs of superposed fasteners (4) on as many pairs of sequential indentations (5) by means of inlet eyelets (4*a*) and outlet eyelets (4*b*), circumscribing passage slits of said fasteners (4), wherein said eyelets are exactly equal and coaxially aligned with each other.

3.The element of load-bearing structures as defined in claim 1 wherein said fasteners (4) with inlet eyelets (4*a*) and outlet eyelets (4*b*) having identical sections are formed by means of molding with simultaneous shearing and drawing.

* * * * *